US005986676A

United States Patent [19]

Dwin et al.

[11] Patent Number: 5,986,676

[45] **Date of Patent: *Nov. 16, 1999**

[54] DEVICE FOR PROTECTING SELECTED INFORMATION IN MULTI-MEDIA WORKSTATIONS

[75] Inventors: David Ronny Dwin, Carrboro; William Robert Lee, Apex; David William Nuechterlein, Durham, all of N.C.; Paul Stewart Yosim, Boulder, Colo.

[73] Assignee: International Business Machines Corporation, Armonk, N.Y.

[ * ] Notice: This patent is subject to a terminal disclaimer.

[21] Appl. No.: 08/888,717

[22] Filed: Jul. 7, 1997

Related U.S. Application Data

[63] Continuation of application No. 08/322,673, Oct. 13, 1994, Pat. No. 5,764,964.

[51] Int. Cl.[6] ..... G09G 5/36

[52] U.S. Cl. ..... 345/509; 345/501; 348/739; 711/173

[58] Field of Search ..... 345/501, 507–509, 345/512; 711/170, 173

[56] References Cited

U.S. PATENT DOCUMENTS

| | | | |
|---|---|---|---|
| 4,994,912 | 2/1991 | Lumelsky | 345/213 |
| 5,220,312 | 6/1993 | Lumelsky et al. | 345/515 |
| 5,274,753 | 12/1993 | Roskowski et al. | 345/435 |

*Primary Examiner*—Kee M. Tung
*Attorney, Agent, or Firm*—Joscelyn G. Cockburn

[57] ABSTRACT

The display buffer of a multimedia workstation is partitioned into a display section and a non-display section. The information to be displayed on the display screen is arranged in the display section of the display buffer. An image or shadow of the display section is written in the non-display section (called a lock buffer) of the display buffer. Prior to updating the display section, a controller reads the protection data from the lock buffer and generates control signals which inhibit the writing of data into protected areas of the display section.

8 Claims, 8 Drawing Sheets

| FIG. 2A | FIG. 2B |
|---|---|

DEVICE FOR PROTECTING SELECTED INFORMATION IN MULTI-MEDIA WORKSTATIONS

This is a request for filing a continuation application under 37 CFR §1.60, of pending prior application Ser. No. 08/322,673filed on Oct. 13, 1994 now U.S. Pat. No. 5,764,964.

BACKGROUND OF THE INVENTION

1. Field of the Invention

The present invention relates to workstations in general and, in particular, to multi-media workstations in which full motion video images and computer generated information (graphic and non-graphic) are shown on displays.

2. Prior Art

The proliferation of multi-media workstations creates the need for new techniques and/or devices to process multi-media information. Generally, the multi-media workstation is capable of processing electrical signals representative of voice, data, and video information. As a general proposition, the different types of information (i.e., data, voice, or video) are propagated on a common transmission medium.

A conventional workstation is comprised of a controller, which is usually a personal computer (PC), and one or more Input/Output (I/O) devices. The I/O devices may include printers, displays, etc,. The display unit is an important I/O device. It gives a user a visual image of information inputted into the system and results based upon queries from the user. A conventional device, commonly known as a video adapter, couples the display device to the bus of the PC. An operating system, such as OS/2$^R$, is executed on the PC and provides the necessary facilities (e.g., interfaces, protocols, format, etc.) for providing information on the display via the video adapter. The OS/2$^R$ product includes multitasking features which allow it to partition the display screen into separate areas or windows in which selected information can be inserted and displayed to the user.

It is desirable for multi-media applications to display full motion video simultaneously with conventional computer graphic information in a windowing environment. Many primary sources of full motion video are in a format known as National Television Standards Committee (NTSC). An NTSC video image is composed of successive frames. Each frame consists of an interlaced odd and even field. Each field has 262.5 scan lines, approximately 240 of which contain video information. Therefore, each frame has 480 interlaced lines of video information.

The mixing of Real-Time Video information with computer originated graphics information on a window display screen presents several significant challenges in the development of a robust and reliable multi-media workstation.

Among the challenges is the protection of graphic windows with graphic information and/or icons (called protected information) from being obliterated (overwritten) by video or other realtime information in the Real-Time Video Window (RTVW) The protected information is usually positioned in the RTVW. The protected information could be considered as being static (i.e., changes less often), whereas the video information is dynamic (changes more often). In fact, every picture element (Pixel) in the RTVW is overwritten up to sixty times per second, whereas the graphic information is written less frequently. Unless devices are provided to protect the static data, it would be destroyed. It is this problem the present invention addresses.

SUMMARY OF THE INVENTION

It is a main object of the present invention to provide a device with improved functions for protecting relatively slow time varying information from being overwritten by relatively faster time varying information, including video.

The protection is provided by a device which allows the static information, including graphic windows and/or icons, to overlay or underlay the Real-Time Video Window containing the time varying information.

In particular, the display buffer is partitioned into a display buffer section and a lock (secured) buffer section. The information to be displayed on the screen is positioned in the display buffer section. Usually, the information in the display buffer section is mixed, containing RTVW, graphics windows and icons. The windowing (arrangement) of the display buffer section could be done by a dedicated programmed microprocessor or a conventional system processor executing a windowing operating system, such as OS/2$^R$ or the like and an appropriate program.

The processor generates lock data based upon the relative position of video information and the information to be protected in the display buffer section and stores the lock data in the lock buffer section of the display buffer. A controller, preferably hardware and/or firmware, reads the lock data and generates WRITE and NO-WRITE signals, therefrom. A memory sequencer responsive to the WRITE and NO-WRITE signals allows information to be written or not written in the display buffer section. As a consequence, the graphic windows and icon information are protected to overlay and/or underlay the video information in the display buffer and the display. Even though the video information is being refreshed at a rapid rate, the protected information is not overwritten or destroyed. The accompanying drawings, which are incorporated in and constitute a part of this specification, illustrate one embodiment of the invention and, together with the description, serve to explain the principles of the invention

DETAILED DESCRIPTION OF THE PREFERRED EMBODIMENT

Figure 1:
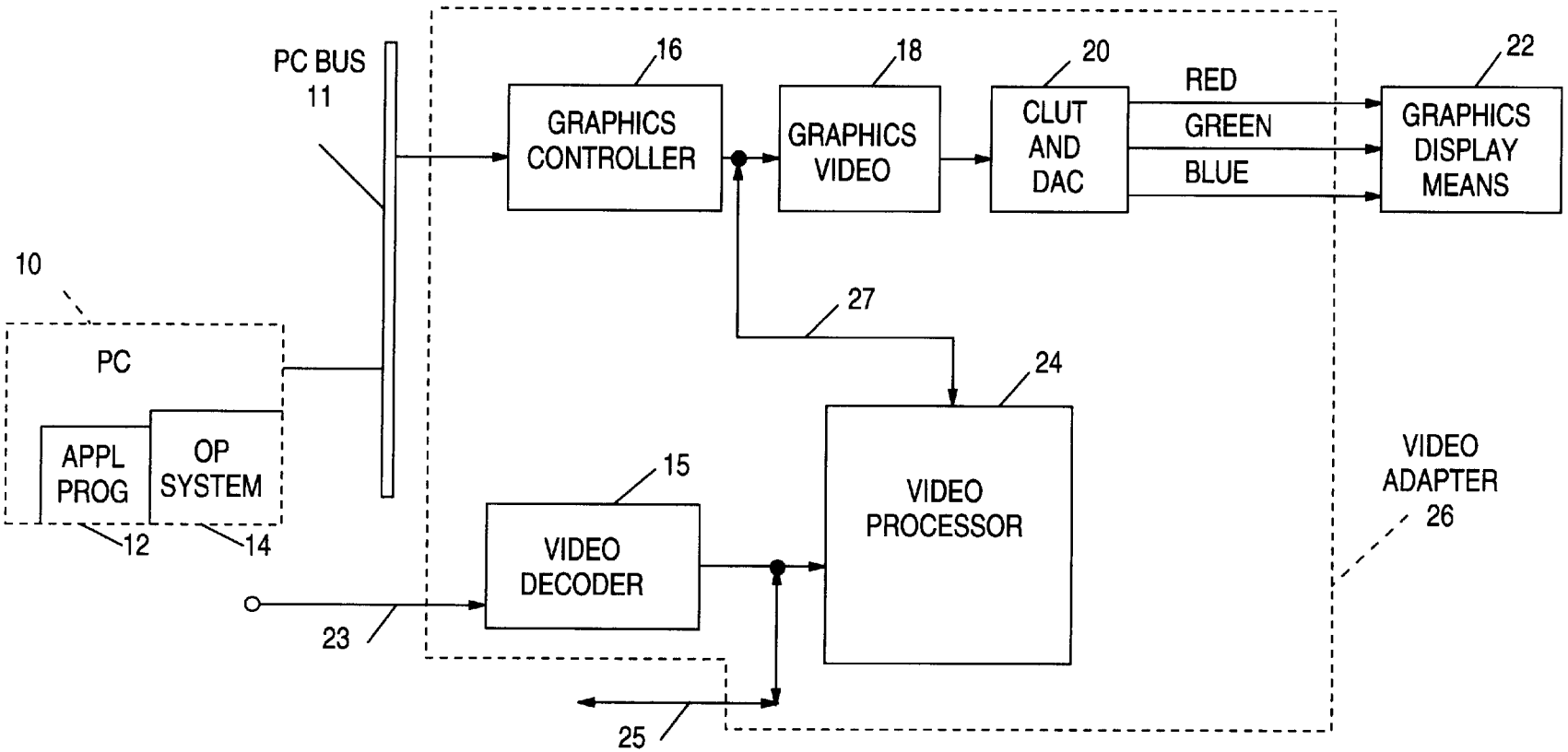
FIG. 1 shows a block diagram of a system, such as a multi-media workstation, embodying the teachings of the present invention.

FIG. 1 shows a system diagram, including the teachings of the present invention. The system includes a personal computer (PC) 10 with a PC Bus 11 shown externally for purposes of description. A video adapter 26 is coupled to PC Bus 11 and provides real time television images, which are displayed simultaneously with computer graphics and/or text data, some of which are protected on a conventional graphics display means 22, such as a CRT or flat panel display means. The PC 10 executes an operating system 14 which provides multitasking functions and windowing on the graphic display in which the video image, text and/or graphic data and protected information are displayed. Any conventional multitasking operating system such as OS/2$^R$ can be used in PC 10 to provide the multitasking environment and the windowing partitioning of the graphic display means 22. In addition, one or more application programs, such as application program 12 which is a user-provided item, could be executed in PC 10 on top of the operating system 14. Such an application, if required, could provide information relative to the protection mechanism (to be described subsequently) in video processor 24.

Still referring to FIG. 1, the video adapter 26 includes graphics controller 16, graphics video buffer 18, color look-up table/digital to analog converter (CLUT/DAC) means 20, video decoder means 15, and video processor 24. The interconnection of the named units are shown in FIG. 1 and, for brevity, will not be repeated. The graphics controller 16 can be purchased as a standard off-the-shelf item. It attaches to a computer system bus, such as PC Bus 11, and allows (and/or assists) an application program, such as 12 running in the PC 10, to alter the contents of the graphics video buffer 18 and to control the operation of video processor 24.

The graphics video buffer (GVB) 18 is a memory buffer having, according to the teachings of the present invention, a display section containing data which corresponds to regions of the graphic display screen 22. The area of the memory buffer that contains the graphics and/or video data displayed on the screen is commonly referred to as a frame buffer. According to the teachings of the present invention, the section of the video buffer called a "lock-buffer" carries lock data which is an image or shadow of the frame buffer. As will be described in more detail hereinafter, a lock buffer controller uses the contents of the lock buffer to determine the location in the frame buffer whereat information can be written. Consequently, selected information can overlay and/or underlay video information in the frame buffer and ultimately on the display screen.

Still referring to FIG. 1, the color look-up table/digital to analog converter (CLUT/DAC) 20 provides a final mapping from the particular frame buffer representation into an analog RGB (Red, Green and Blue) signal necessary to drive the graphics display 22. The CLUT/DAC 20 is a conventional off-the-shelf device and further description will not be given, The video decoder 15 is a standard device which decodes a composite or S video signal into analog RGB or YUV, and then digitizes it to produce a digital RGB or YUV representation of the signal on its output. The video signal or terminal 23 can be provided in the NTSC on PAL (phase alternation line) format. In addition to the video image on terminal 23, a decompressed video image from a codec (compression/decompression) source (not shown) can also be provided on conductor 25. The video image on conductor 25 or the video image outputted from the video decoder 15 is forwarded to video processor 24. The video processor 24 is interconnected by bidirectional bus 27 to the graphic controller 16 and the graphic video buffer 18. As will be explained in greater detail hereinafter, the video processor 24 receives real time video images and among processing functions provided crops the images horizontally and vertically, scales the images horizontally and vertically, provides the lock mechanism which generates control signals which inhibit the writing and/or refreshing of data in selected areas of the frame buffer, and converts the image data to the desired color space (RGB to YUV or YUV to RGB). The video processor then transfers the scaled/color space converted image into the correct location within the frame buffer for display on the graphic display screen 22.

Based on the above description, it can be concluded that video input signals from a TV turner, video, tape recorder, or video camera presented in NTSC or PAL standard format or as a decompressed video stream from a video codec are processed, including the preservation of data, such as icons or the like by video processor 24, and are displayed in an adjustable size window on computer graphic display screen 22 simultaneously with other graphics or text data on the display. In addition, due to the locking mechanism feature of the present invention, selected graphic and/or icons are made to overlay and/or underlay the graphics (video information).

Figure 2A:
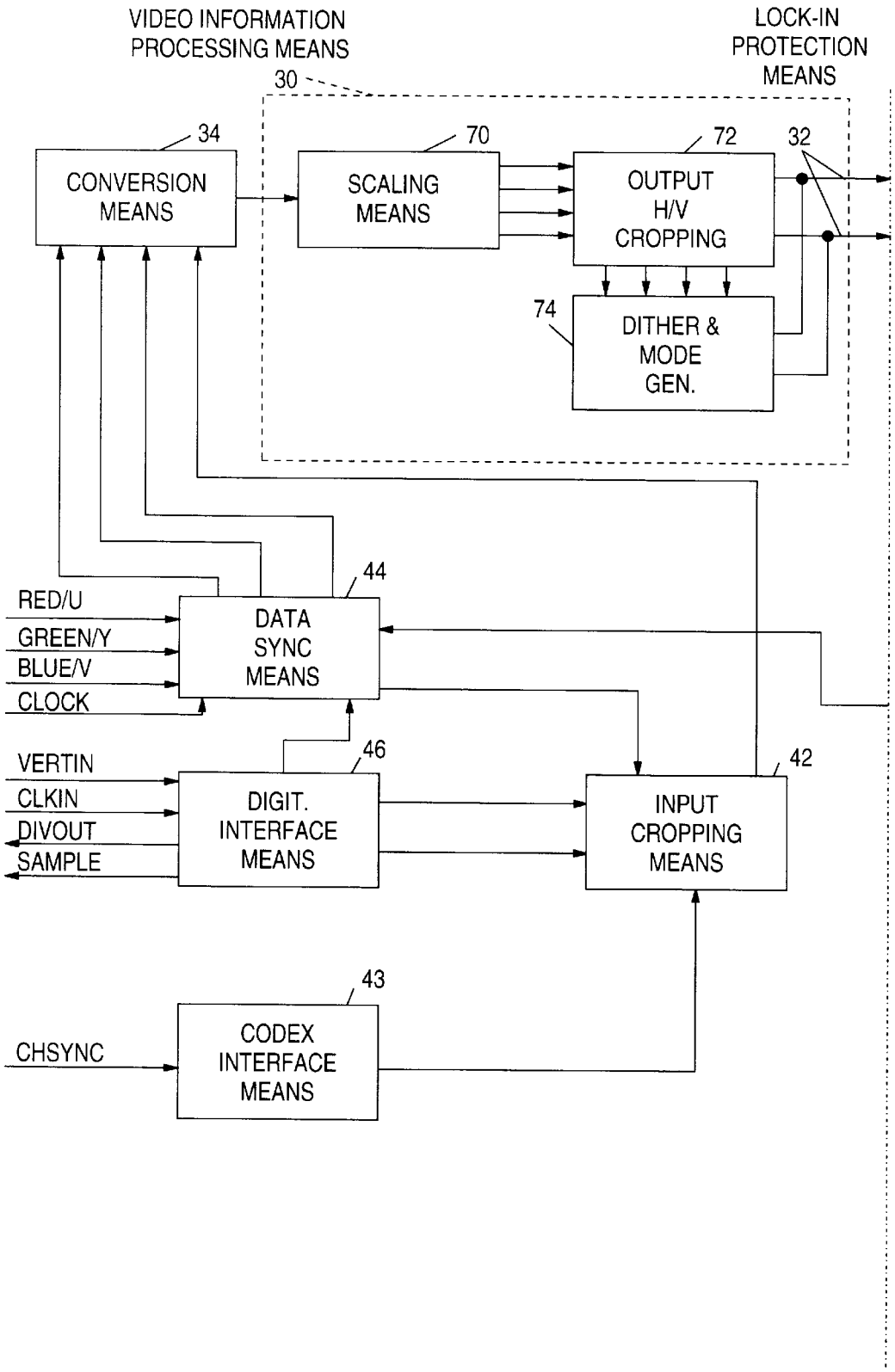
FIGS. 2A and 2B show a block diagram of a video processor module with lock-in protection used in FIG. 1 to process full motion videos. Lock-in protection denotes the capability to protect graphics data from being over-written by the RTVW.
Figure 2B:
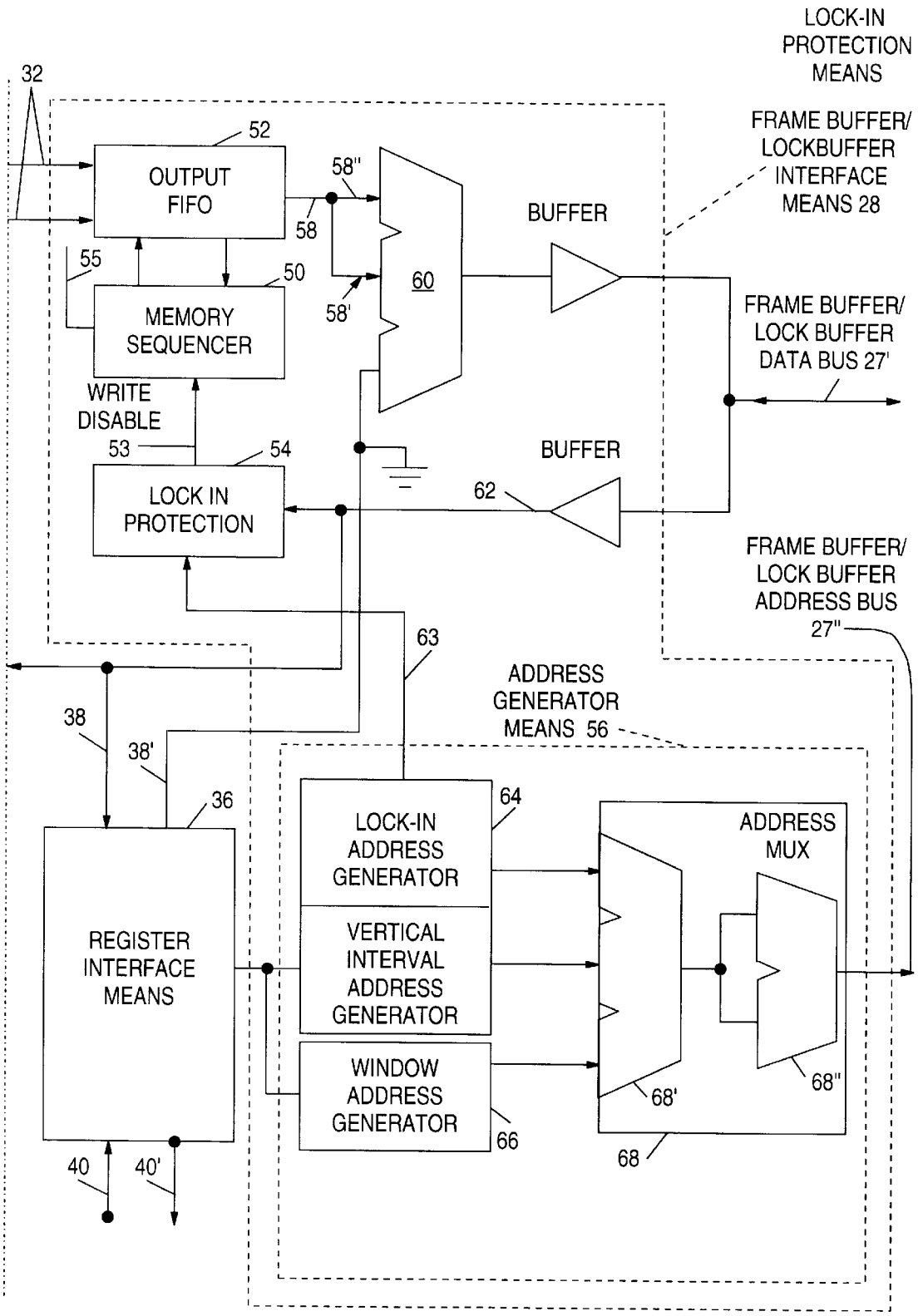

FIGS. 2A and 2B show a detailed block diagram of video processor 24. As described previously, the video processor processes video information and places the information in selected areas of the video buffer from whence the information is displayed in selected windows of the computer graphic display screen 22. In addition, the video processor 24 provides the locking mechanism to ensure selected areas of the frame buffer or video buffer are not written or refreshed. As a consequence, selected information can be overlayed or underlayed video information in the buffer. As is used in this document, process means the "video processor" prepares the video information so that it can be displayed on the video screen simultaneously with computer generated graphics/data information.

The video processor 24 includes frame buffer/lock buffer interface means 28 which is coupled to the frame buffer/lock buffer via frame buffer/lock buffer data bus 27' and frame buffer/lock buffer address bus 270". It is worthwhile noting that the data bus 27', and the address bus 27", are identified in FIG. 1 by numeral 27. The frame buffer/lock buffer interface means 28 provides the facility and function through which high speed video information is inserted in selected areas of the video buffer 18 (FIG. 1). The video information processing means 30 receives the high speed video information from conversion means 34, processes the information and transmits it via bus 32 to the frame buffer interface means 28. The register interface means 36 is connected via bus 38 and 38, to the frame buffer/lock buffer interface means 28. Access into and out of the register interface means 36 is obtained via data bus 40 and 40', respectively. The video information into conversion means 34 is provided over respective conductors from input cropping means 42 and data synchronization means 44. Information into the data synchronization means 44 is provided via digitized interface means 46 and data into the input cropping means 42 is provided over conductors from codec interface means 43 and digitized interface means 46. Signals into and out of the data synchronization means 44, digitized interface means 46, and codec interface means 43 are shown by respective arrows and are labeled accordingly.

Still referring to FIGS. 2A and 2B, the frame buffer/lock buffer interface means 28 includes memory sequencer 50 which is connected to output FIFO 52. The memory sequencer 50 is enabled, via a control signal on terminal 55, to control or manage the memory. The signal terminal 55 is provided by the graphics controller means 16 (FIG. 1). Another control into memory sequencer 50 is Write Disable on conductor 53. The signal is provided by Lock-In Protection means 54. Details of the Lock-In Protection means 54 will be given hereinafter. Suffice it to say, whenever the Write Disable signal is active, the memory sequencer 50 inhibits (prevents) the writing of data into the frame buffer.

Turning to FIG. 2B for the moment, the memory sequencer 50 provides all direct memory control signals to manage the frame buffer and lock buffer. As stated previously, both buffers are contained in storage means 18 (FIG. 1). The memory control signals include RAS (Row Address Strobe), CAS (Column Address Strobe), WE (Write Enable) and OE (Output Enable), etc. In addition, the memory sequencer 50 provides control signals for the reading of the output FIFO buffer 52 and the advancing of addresses via the address generating means 56 (to be discussed subsequently). The output from the output FIFO buffer 52 is fed over bus 58, busses 58' and 58" to multiplexor means 60. The output from multiplexor 60 is fed over the buffer data bus 27'. Another input to multiplexor means 60 is fed over bus 38' from register interface means 36 which interfaces the video processor with external devices, such as the PC 10 or the like (FIG. 1). The output FIFO buffer 52 buffers video data and control information, including No-Write signals, which are held until the memory sequencer 50 gains control or access to the video buffer and lock buffer via interfaces means 28. Once access or control is obtained, the contents of the output FIFO buffer 52 is transmitted into frame buffer 18 (FIG. 1). Of course, the protected area of the frame buffer is not written into as a result of the teachings of the present invention.

Still referring to FIG. 2B, the address generator means 56 comprises vertical interval address generator 64, Lock-In Address generator 64 and window address generator 66. The output signals from each of the generators are fed into address multiplexor means 68. The address multiplexor means 68 is comprised of two multiplexor means 68' and 68" connected in tandem. The window address generator 66 provides the addresses necessary to write the line-video window data into the graphics video buffer memory 18.

The vertical interval address generator 64 provides the addresses necessary to write a captured vertical blanking interval data stream to the graphics video buffer memory 18. The lock-in address generator 64 generates the addresses necessary to access locations in the lock buffer.

Address multiplexor 68' selects which address generator shall source addresses for memory cycles to the graphics video buffer 18 (FIG. 1). Address multiplexor 68' is an 18 bit 3-to-1 multiplexer with the selection sourced from the memory sequencer 50 providing a single 18 bit address.

Address multiplexor 68" selects which half of the 18 bit address shall be output to the graphics video buffer 18. The graphics video buffer is made up of either DRAM or VRAM, which uses a 9-bit multiplexed address. Address multiplexor 68" provides the proper 9-bit address with the selection sourced from the memory sequencer 50. The register interface means 36 provides the data path and primary interface control allowing either the system PC or the graphics controller access to the entire set of configuration registers within the video processor 24. Data into and out of the register interface means 36 on bus 40 and 40' respectively are generated in the system PC and/or the graphics controller.

Still referring to FIGS. 2A and 2B, the video information processing means 30 includes the scaling means 70, output H/V cropping means 72 and dither and mode generator means 74. The scaling means 70 receives on its input high speed video information and scales or reduces the size of the information to fit a selected window on the computer graphics display. The output H/V cropping means 72 performs the final truncation necessary to size the scaled window to the exact pixel boundary desired in the computer operating system environment. This function is necessary since the scaling algorithm does not have a single pixel granularity.

The dither and mode generator means 74 provides dithering down (reduction) to RGB-16 or RGB-8 from RGB-24 bits per pixel. It should be noted that dithering is a well known high quality method of reducing the storage necessary for an image with minimum quality degradation. The conversion means 34 receives at its input video signals and converts them to digital RGB and delivers them to the scaling means 70, details of which are set forth in the above referenced docket and to the extent necessary to complete the background information are incorporated herein by reference. The data into conversion means 34 are provided over respective conductors from data synchronization means 44 and input cropping means 42. The input cropping means 42 extracts the active video data from the digitized video source. There are portions of time (horizontal and vertical blanking intervals) when active video data is not present. The input cropping means 42 captures the active data and skips over the blanking interval where there is no data. The digitized interface means 46 provides the control necessary to interface directly to the electronics that decodes and captures data from the NTSC signal. The codec interface means 43 provides the control necessary to interface directly to a video codec (compressor/decompression). Data sync means 44 receives a 24-bit pixel bus that may be either red 8-bits, green 8-bits, blue 8-bits digitized, or Y (luminance) 8-bits, V-8-bits, U8-bits (chrominance) digitized. Luminance (Y) and chrominance (U, V) are basic components of PAL and NTSC television signals. This pixel data bus is sourced from either the codec means (not shown) which would have been connected to conductor 25 or TV source means (not shown) which would have been connected to node 23. All pixel data enters the video processor through this bus.

Two separate clocks are provided to the data sync means 44. The codec clock provides the timing at which to capture the input pixel bus and propagate a codec pixel. In the same manner, the digitizer codec provides the timing to capture the input pixel bus and propagate a digitized pixel.

The codec interface means 43 receives only one input, the CHSYNC or Codec CHSYNC. This input provides the timing instructing the video processor that a full input line of codec video data has been completed. The vertical sync is always sourced from the video digitizer and the codec must synchronize to the video digitizer vertically.

The digitizer interface means 46 receives an input clock CLKIN driven directly from the phase lock loop of the video decoder 15. The frequency of this input varies from 33 Mhz to 17 Mhz operating as the VCO output at the phase locked loop. DIVOUT is a programmably divided down signal which is output to the video decoder's phased lock loop as the reference signal to the phase locked loop. When in lock, DIVOUT's falling edge stays in constant phase with the horizontal sync of the video decoder. SAMPLE is the clock to the video digitizer's analog to digital converter and commands the video digitizer to provide a digitized pixel to the video processor.

VERTIN is the vertical sync signal from the video digitizer. This signal acts as a reset to the video processor, instructing the video processor that the current field of video has completed and the next field is to begin. Having described the improved multi-media terminal, the remaining portion of this document will give a more detailed description of the protection mechanism which prevents overwriting of selected information in the frame buffer.

Figure 3:
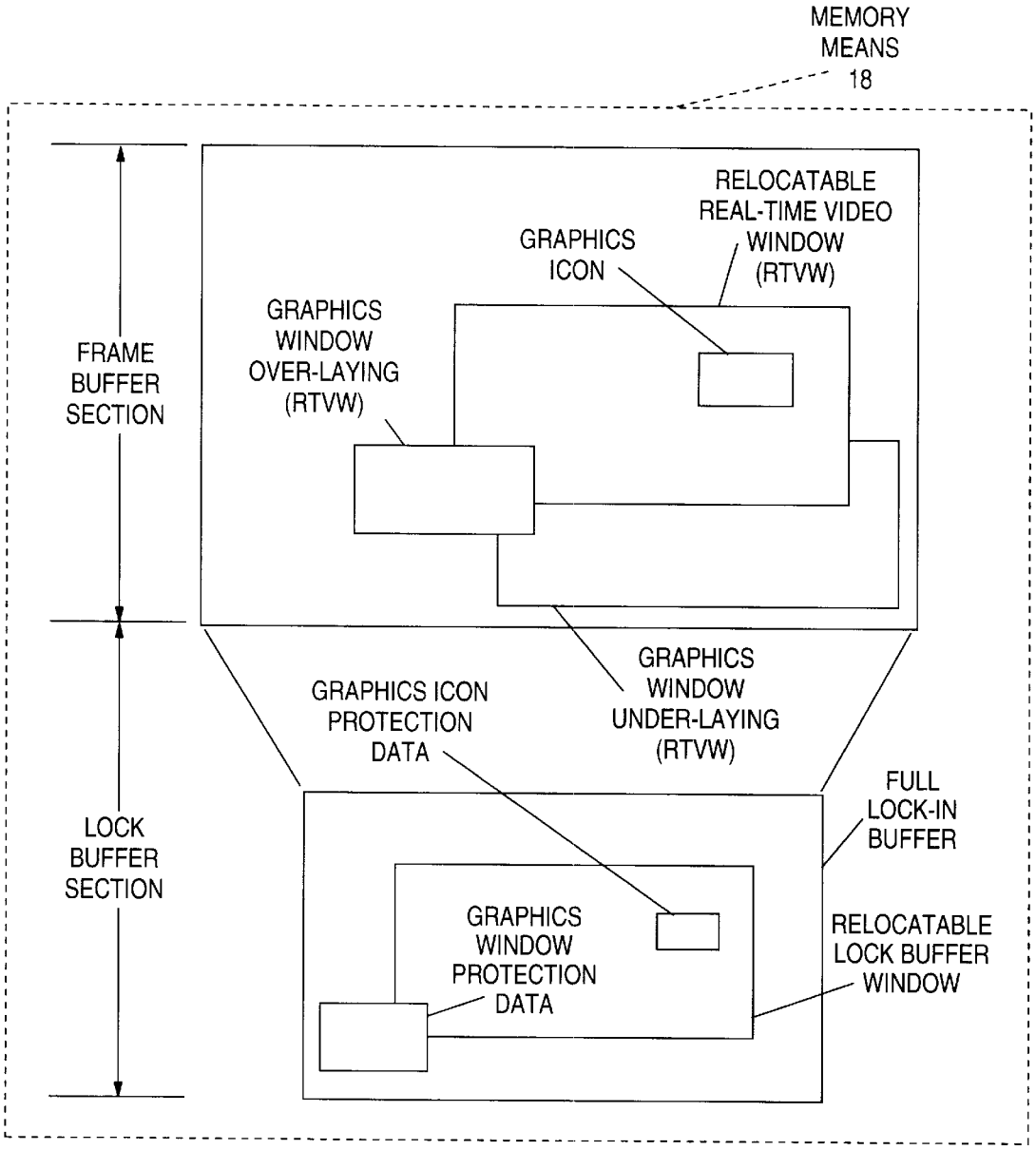
FIG. 3 shows a graphical representation of the lock-in protection feature in accordance with the teaching of the present invention.

FIG. 3 shows a conceptual representation of the protection features according to the teachings of the present invention. The memory storage means 18 (FIG. 1), which stores video and computer generated information for displaying on the graphic display means 22, is partitioned into a frame buffer section and a lock buffer section. The frame buffer section is the screen memory which stores a full screen of data to be displayed on the graphic means, such as display 22 (FIG. 1). The lock buffer section is a non-display memory and stores lock data which protects selected areas in the frame buffer section. The contents of the frame buffer section is organized under the control of a windowing operating system, such as OS/$2^R$, running in the processor 10 (FIG. 1) with an appropriate application program. The use of multitasking software to arrange a desired set of windows in the frame buffer for display on a display device is well known in the art. Therefore, detailed description of how the PC sets up the selected information in the frame buffer section will not be given.

The specific structure of information shown in the frame buffer section of FIG. 3 is only an example, and it is well within the skill of the art to provide different arrangements of the data without deviating from the teachings of the present invention. It should also be noted that the data structure shown in the frame buffer section would be the information display on the display screen. By managing the frame buffer according to the teachings of the present invention, selected areas of the screen can be protected against overwriting, even though the video information in the frame buffer section is refreshed (i.e., rewritten) several times within a specified time interval.

Still referring to FIG. 3, the frame buffer section includes a Real-Time video Window (RTVW) which can be relocated, a graphics window overlaying the Real-Time Video Window, a graphics window underlaying RTVW, and a graphics icon overlaying the Real-Time Video Window. An image or shadow of the frame buffer section is captured or is generated and related data representing the image is stored in the lock buffer section. An alternative technique to storing the entire frame buffer image would be to store data representing only the information to be protected in the lock buffer. As a result, the graphic icon protection data protecting the graphic icon is maintained in the lock buffer. The relocatable lock buffer window data protects the relocatable Real-Time Video Window and the graphics window protection data protects the graphic window overlaying the RTVW. Once the lock data is placed in the lock buffer, subsequently writing into the frame buffer is controlled by the contents of the lock buffer. In particular a controller (to be described subsequently) reads the protection data in the lock buffer section and generates the Write/No-Write control signal which is used by the memory sequencer to write data in the frame buffer section. As a consequence, protected information can be maintained even though the real time video changes rapidly.

Software running in the PC must update the lock buffer portion of the frame buffer when the RTVW is moved or when graphics information that is to overlay the real time video window (RTVW) is created and/or resized or repositioned. Graphics objects that have lower visual priority (i.e., underlay) the RTVW do not "cast a shadow" in the lock buffer. The underlayed graphics objects do not require any special handling with respect to the lock buffer, for the RTVW will naturally overlay all graphics objects that are not protected by the lock buffer.

This lock buffer management software must keep a table of all graphics objects that are to overlay the video window. This table includes either the width, height and starting coordinate or the four coordinates at the four corners of the window. If the graphics object is not square or is partially transparent, a local copy of the desired lock buffer for the object should be kept in system memory. In addition, the table should contain a priority number. For a given object, this number being greater than the RTVW priority, indicates the object should overlay the RTVW.

Figure 4A:
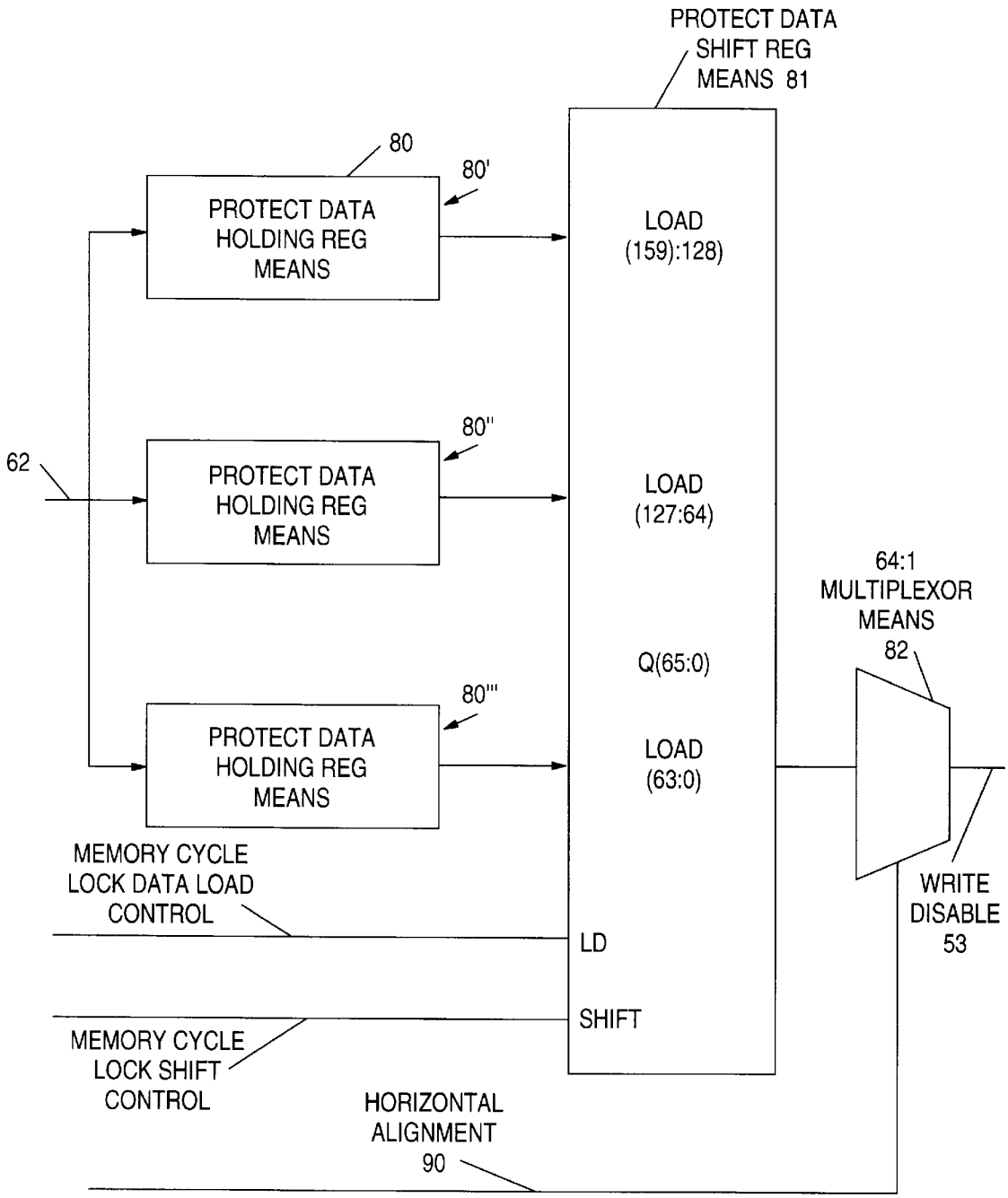
FIG. 4A shows a block diagram of the circuit used to generate the write/no write signal used by the memory sequencer means to implement this lock-in protection feature.

When a graphics object is resized or positioned, the lock buffer management software must check to see if the object overlays or underlays the RTVW. If the object overlays the RTVW, (i.e., determined by the table values for priority), the new location of the graphics object must be protected first. This is done by setting all the protect bits corresponding to the pixels in the destination for the object. Once this is done, the windowing operating system software must move the graphics object to the new location. Table entries must then be updated for the newly relocated graphics object. The previous location must be cleared from the lock buffer. This will enable the video processor to overwrite the old copy of the graphics object. The table must be checked to see if other graphics objects overlay this area of the frame buffer first. Once it is determined that other objects do not overlay the previous location of the relocated graphics object, the corresponding lock must be cleared. FIG. 4A shows a block diagram of a circuit in the Lock-In Protection Means 54 (FIG. 2B) which generates the Write/No-Write Control Signal. Similarly, FIGS. 5A and 5B show graphical representation of the Horizontal Alignment State machine.

FIG. 4A is the Lock-In Protection means 54 as referenced in FIG. 2B. Conductor 62 provides access for the memory data bus to be captured by the Protect Data Holding Reg. Means 80. The memory sequencer means 50 provides the necessary controls which instruct Protect Data Holding Reg. means 80, when to capture the data on conductor 62. Once an entire video line of data is captured by means 80, the memory sequencer then loads the entire contents of means 80 into the protect data shift reg. means 81. At this point, the 160-bit wide shift register means 81 is ready to shift forward through the lock data. For each memory cycle that writes video to the frame buffer, performed by the memory sequencer means 50, the protect data shift reg. means 81 is shifted. This is done via the control signal "memory cycle lock shift control", which also originates from the memory sequencer. Because the lock buffer is a contiguous array of pixels that has a correspondence to the pixels of the frame buffer, where the uppermost or left-most screen pixel is protected by the least significant bit of the data word at the address pointed to by the first address of the lock buffer. Consequently, the lowermost and the rightmost screen pixel is protected by the most significant bit of the data word that is pointed to by the last address of the lock buffer. Because the video window can be positioned anywhere on the screen, the lock protect bit which protects the leftmost pixels of the video window can be positioned anywhere within the memory data word. This position for the entire set of leftmost pixels also can vary. The 64:1 multiplexor means 82 provides the mechanism to properly align the lock data within the protect data shift reg. means 81. The horizontal alignment conductor 90 is a 6-bit value selecting 1 of the possible 64 alignments for the leftmost pixels of the video window found in the memory data word.

Figure 4B:
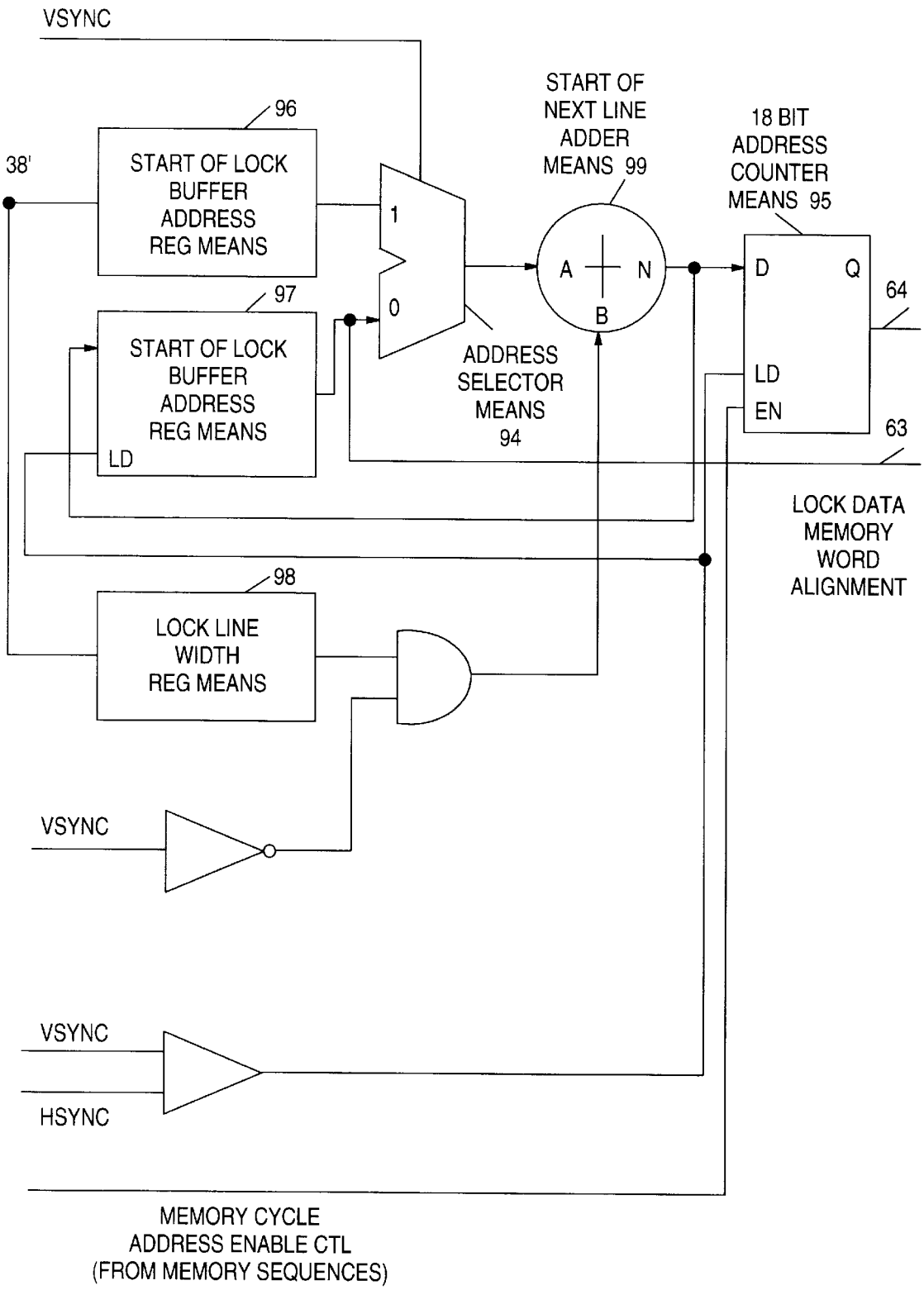
FIG. 4B shows a block diagram of the controller used to generate the address necessary when reading the contents of the lock buffer.
Figure 5A:
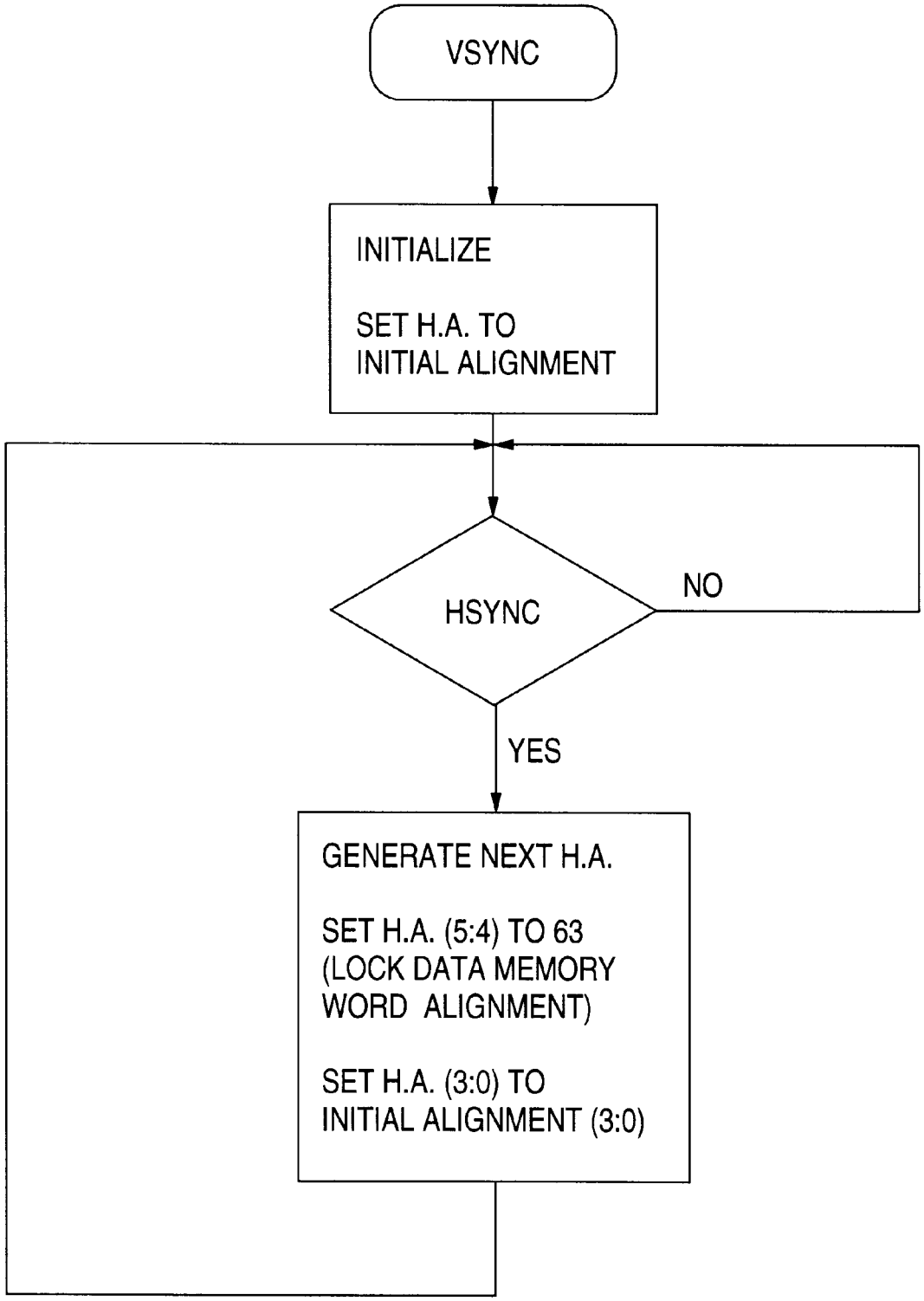
FIG. 5A is a flow chart of the horizontal alignment generator FSM used to calculate the starting location of the lock data within the memory word that has been previously read by the memory sequencer means 50.
Figure 5B:
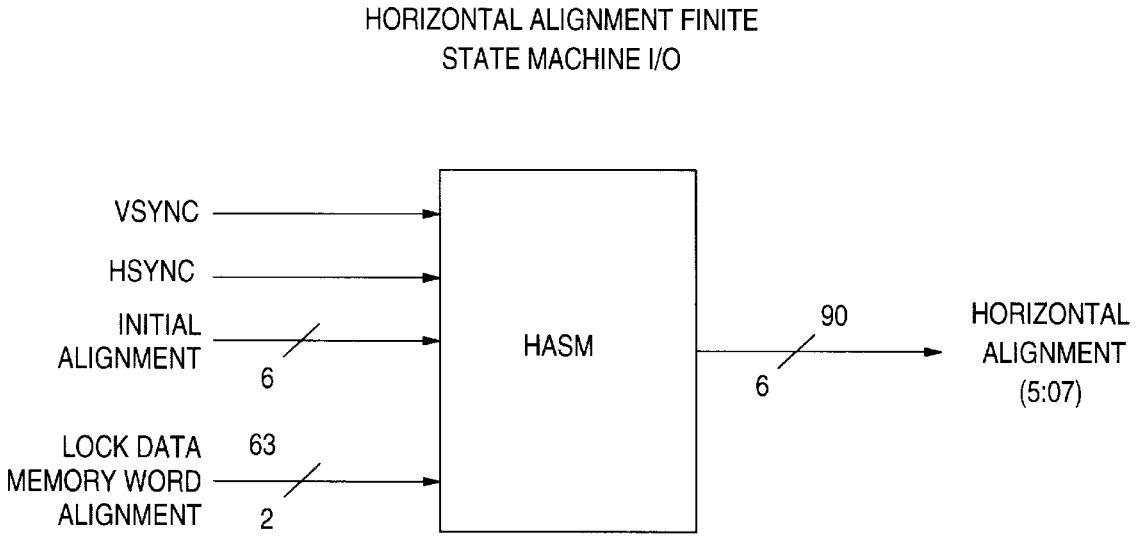
FIG. 5B shows a graphical representation of the horizontal alignment finite state machine.

FIG. 5A shows the flow chart which is used in the horizontal alignment finite state machine (HASM) FIG. 5B to generate the proper horizontal alignment. In FIG. 5B, there is a conductor 63, (lock data memory word alignment), which controls the dynamic portion of the alignment for the leftmost lock pels of the video window in the lock buffer. Conductor 63 originates from the lock-in address generator means 63 of FIG. 4B. This 2-bit conductor represents which quarter of the memory data word that the leftmost lock pel of the video window will be found. Since the graphics modes (in this implementation) have lock line widths that require a granularity of ¼ of a memory data word; only 2-bits are required. However, this invention can easily support greater granularity via the widening of conductor 63.

FIG. 4B shows a block diagram of the lock-in address generation means 62. At the beginning of a field of video, the VSYNC is issued. The VSYNC forces the "start of lock buffer address" held in means 96, to be loaded into the 18-bit address counter means 95 and the start of lock line address reg. means 97. This is done through address selector means 94 (selected for path 1), and through the start of next line adder means 99 (input B set to 0). The VSYNC properly initializes the circuit. Once initialized, the output conductor 64 holds the first memory address to be used for reading the lock buffer. The memory sequencer means 50, FIG. 2B, then performs lock buffer data reads. For lock reads, the memory sequencer issues the control to advance the 18-bit address counter means 95, through the "memory cycle address enable control". When the entire line of lock data has been read, the HSYNC may be issued to perform the calculation of the address of the start of the next line of lock data. Upon the HSYNC, the current start of lock line address is added to the lock line width to generate the start of next lock line address.

The system diagrammed in FIG. 1 shows an operating system 14 running on application program 12. As an example of how the system can be used to control the mixing of graphics and video, the PC is being used as a TV and the entire screen is dedicated to the video information. The application must update a graphics overlayed clock in the top right portion of the screen. System operation requires a timer interrupt to the CPU every minute. The CPU or PC means 10 (FIG. 1), must service this interrupt by determining the current time, clearing the lock buffer allowing video to overwrite the old time, setting the lock buffer to protect only those pels which are needed to keep video from over-writing the current time. This might be "04:30 P.M.", for example. Once the new time is protected, the new time must be written to the frame buffer. The CPU can then return back to the operating system until the next interrupt where the process repeats.

While the invention has been particularly shown and described with reference to a preferred embodiment thereof, it will be understood by those skilled in the art that various changes in form and details may be made therein without departing from the spirit and scope of the invention.

Having thus described our invention, what we claim as new, and desire to secure by Letters Patent is:

1. A video adapter card for use in a multi-media workstation including:

a memory partitioned into at least one section, display buffer, in which time-sensitive information including video information and non-time sensitive information including computer generated data are being stored for subsequent display on a display device and at least another section, lock buffer, in which a replica of the information stored in the at least one section is being stored wherein said replica of information including lock data identifying protected areas for carrying protected information, not to be destroyed, in the display buffer; and a video processor operatively coupled to the memory, said video processor monitoring the lock buffer and based upon information therein generating control signals which inhibit writing of information in protected areas of the display buffer.

2. The video adapter card of claim 1 further including a first interface means for coupling the adapter card to a computer system bus; and a second interface means for coupling the video adapter card to the display device.

3. The video adapter card of claim 2 wherein the first interface means includes a graphic controller.

4. The video adapter card of claim 2 wherein the second interface means includes a CLUT and DAC.

5. The video adapter card of claim 1 further including a video decoder for receiving video information and supplying said video information to the video processor.

6. The video adapter card of claim 1 wherein the video processor includes address generation means for generating address signals representative of locations in the display buffer and locations in the lock buffer;

an address selector circuity for selecting and outputting address signals on an address bus;

a buffer means for storing video information and control information representing protective areas within the display buffer;

a memory control means for generating the control information couple to the buffer means; and a lock-in protection means coupled to the memory control means;

said lock-in protection means accessing the lock buffer to read lock data and generating therefrom Write or Not-Write signals which control locations in the display buffer whereat information can be written.

7. The video adapter card of claim 6 further including a data bus interconnecting the video processor means and the memory; and a multiplexor circuitry coupling the buffer means to the data bus.

8. The video adapter card of claim 7 further including a register interfacing the video processor and external devices.

* * * * *